US006112960A

United States Patent [19]

Seering et al.

[11] Patent Number: 6,112,960

[45] Date of Patent: Sep. 5, 2000

[54] COMBINATION SLING CARRIER AND CUSHION

[76] Inventors: Mona E. Seering, 1818 S. Blue Gill Ave., Clare, Mich. 48617; Christine L. Seering, 6659 Poplar, P.O. Box 443, Hamburg, Mich. 48139

[21] Appl. No.: 09/359,222

[22] Filed: Jul. 22, 1999

[51] Int. Cl.[7] ..... A45F 3/02

[52] U.S. Cl. ..... 224/158; 224/586

[58] Field of Search ..... 224/158, 159, 224/586; 5/639, 630

[56] References Cited

U.S. PATENT DOCUMENTS

| | | | |
|---|---|---|---|
| 4,606,078 | 8/1986 | Tkacsik . | |
| 4,757,925 | 7/1988 | Knittel | 224/158 |
| 5,383,587 | 1/1995 | Carpenter | 224/586 |
| 5,490,620 | 2/1996 | Berggvist . | |
| 5,857,598 | 1/1999 | Dunne . | |
| 5,950,887 | 9/1999 | Powell | 224/158 |

*Primary Examiner*—Steven Pollard
*Attorney, Agent, or Firm*—Brooks & Kushman P.C.

[57] ABSTRACT

A combination sling carrier and cushion 10 which safely transport an animate object. The device includes a support panel 28, a pocked 32 formed onto the support panel 28 and a carrier band 26. The support panel 28 has two ends 25, 27 where the first end 25 of the support panel 28 is open and the second end 27 of the support panel 28 is closed. The first open end 25 of the panel 28 defining the opening of the pocket 32. The support panel 28 distributes the weight of the object 20 around the shoulders of the wearer 24 and securely supports the object 20 being carried. The carrier band 18 has opposed longitudinal sides 11, 13 and is affixed to the first open end 25 of the support panel 28. The carrier band 18 terminates at second closed end 27 of the panel 28. The carrier band 18 supports the object 20 being carried.

7 Claims, 3 Drawing Sheets

COMBINATION SLING CARRIER AND CUSHION

TECHNICAL FIELD

This invention relates to a combination sling carrier and cushion for safely transporting an animate object and a method for converting the sling carrier into a cushion.

BACKGROUND ART

Carriers have long been known to the art and are available in many different configurations. For example, infant carriers have been fabricated from a flexible fabric and comprise a carrier panel terminating at one end in a tail portion which serves as a sling tie. Buckle rings may be secured to the other end of the carrier panel and the rings function in concert with the tail portion to secure the ends of the panel together and in an adjustable fashion to provide the sling. The sling is formed by passing the tail portion through both of the buckle rings and doubling the tail portion back over one ring and under the other in a conventional fashion. Buckle rings may have serrations along the inner diameter thereof in order to increase the frictional force holding the tail portion in the rings. Many infant sling carriers include padded side rails extending from end to end of the carrier panel and a pillow portion secured to the carrier panel adjacent to the end bearing the buckle rings to provide additional comfort to the infant and the person wearing the sling. While infant carrier slings are effective and convenient for carrying infants, problems securing the carrier panel have been encountered. In particular, the tail portion of the sling may accidentally slip through the buckle rings thereby undoing the slip. This type of mishap can cause great harm to an infant.

Another type of carrier is a child-supporting harness, known in the practice, which is constructed to support the child on the chest-side of the wearer. The harness includes a bag-like support which is firmly joined to two loop harness straps, one for each shoulder, over substantially the whole of its vertical extension on the rear side of the bag. The bag includes leg openings through which the legs of the child extend at the bottom of the bag, and the bag can be opened at one or both sides of the bag in order to enable a child to be placed easily in and removed from the bag. The looped straps have openable locking devices in the region where the straps are joined to the bottom part of the bag, and means are provided whereby the length of the straps can be adjusted. Although this device may securely support a child, the child is positioned such that breast-feeding is difficult if not impossible. Moreover, this carrier does not provide for easy storage capabilities. Furthermore, the child may not be readily transferred out of the carrier if the child is asleep without waking the child.

Consequently, a need has developed for a portable carrier which securely supports an animate object while providing for easy transfers into and out of the carrier and easy storage capabilities.

DISCLOSURE OF INVENTION

It is a principal object of the present invention to safely transport an animate object by providing a support panel which distributes the weight of the object around the shoulders of the wearer and provide secure support to the object being carried and a carrier band which supports the object.

It is another object of the invention to provide a method for converting a sling carrier into a pillow where the sling carrier comprises a support panel having a pocket formed by the support panel and a fabric panel, the sling carrier further comprising a carrier band having pleats, where the method includes the steps of: positioning the carrier with the pleats facing up; folding the carrier band into the pocket; and arranging for the fabric within the pocket to evenly distribute the fabric within the pocket.

It is yet another object of the invention to provide a strong flexible cloth carrier which is the means whereby a wearer can secure an infant or animate object on his or her body.

It is a further object of the invention to provide a one piece cloth carrier.

In carrying out the above objects and other objects and features, a combination sling carrier and cushion for safely transporting an animate object is provided. The combination sling carrier includes a support panel which distributes the weight of the object around the shoulders of the wearer and provides secure support to the object being carried. The support panel has a first closed end and a second open end. Also included is a carrier band having opposed longitudinal sides which supports the object. The carrier band is attached to the first closed end of the support panel and terminates at the second open end of the support panel.

More particularly, the support panel further comprises a first surface for positioning the adjustment for the object being carried, a second surface and a fabric panel which is affixed to the second surface. The fabric panel and the second surface create a pocket for pillow. The pocket stores the support band when the combination sling carrier is in storage.

The support band may be further defined as having at least two padded rails formed in the carrier band and extending along the opposed longitudinal sides of the carrier band. The padded rails attached to the first closed end of the support panel and end at the second open end of the support panel. The padded rail secure the object and the carrier band. The carrier band is pleated at each end to create a natural shelf in the support band for supporting the object.

Still, more particularly, the fabric panel and the carrier band are constructed from a one-piece flexible fabric material.

A method is also provided for converting a sling carrier into a pillow wherein the sling carrier comprises a support panel having a pocket formed by the support panel and a fabric panel. The sling carrier further comprises a carrier band having pleats. This method includes: positioning the carrier with the pleats facing up; folding the carrier band into the pocket; and arranging the fabric within the pocket to evenly distribute the fabric within the pocket.

The above objects and other objects, features, and advantages of the present invention are more readily understood from a review of the attached drawings and the accompanying specification and claims.

BEST MODE FOR CARRYING OUT THE INVENTION

Figure 1:
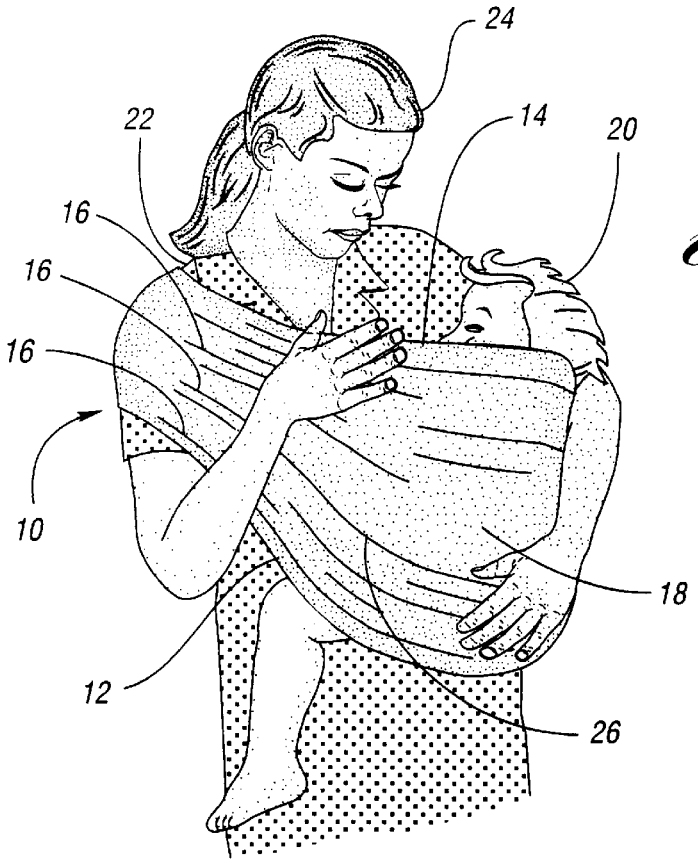
FIG. 1 illustrates the combination sling carrier and cushion supporting a toddler.
Figure 2:
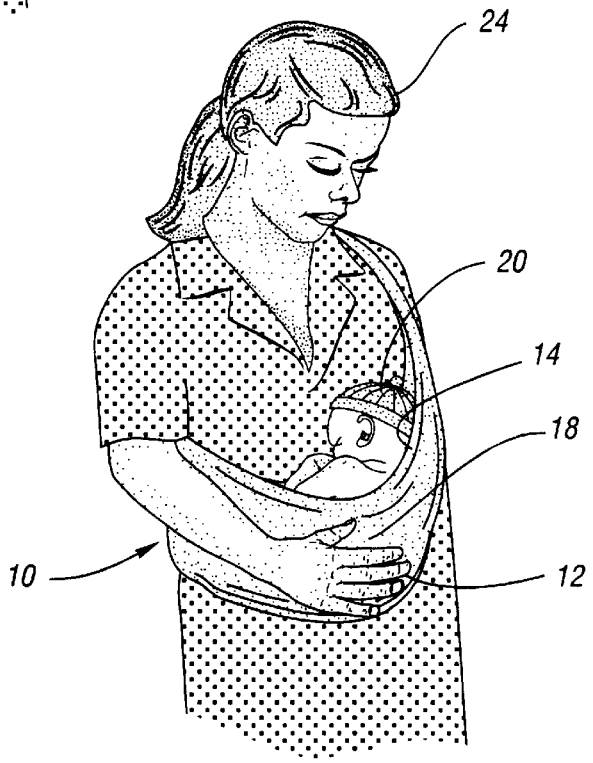
FIG. 2 is an illustration of the combination sling carrier and cushion supporting an infant.

FIGS. 1 and 2 illustrate the outwardly facing side of the inventive combination sling carrier and cushion. As seen in these figures, an infant sling carrier is comprised of a carrier panel generally designated with reference numeral 10. The carrier panel 10 is constructed of a flexible fabric material, such as a cotton, polyester fiber, or any other fabric material suitable for the purpose. The carrier 10 and has a pair of padded side rail portions 12, 14 extending end to end. The padded rails 12, 14 attach to the first closed end 25 of the support panel 28 and end at the second open end 27 of the support panel 28. The padded side rail portions 12, 14 provide additional support for the animate object 20 and secure the animate object 20 in the carrier 10. The pleating 16 in the carrier band 26 creates a natural shelf 18 in which the animate object 20 may rest. This natural shelf 18 secures the object 20 into position and surrounds the animate object 20 with the shelf 18 thereby protecting the object 20 from the outside elements. As illustrated in FIGS. 1 and 2, the present invention supports an animate object 20 by positioning the sling 10 over the shoulder 22 of the wearer 24 and placing the animate object 20 in the carrier band 26.

Figure 3:
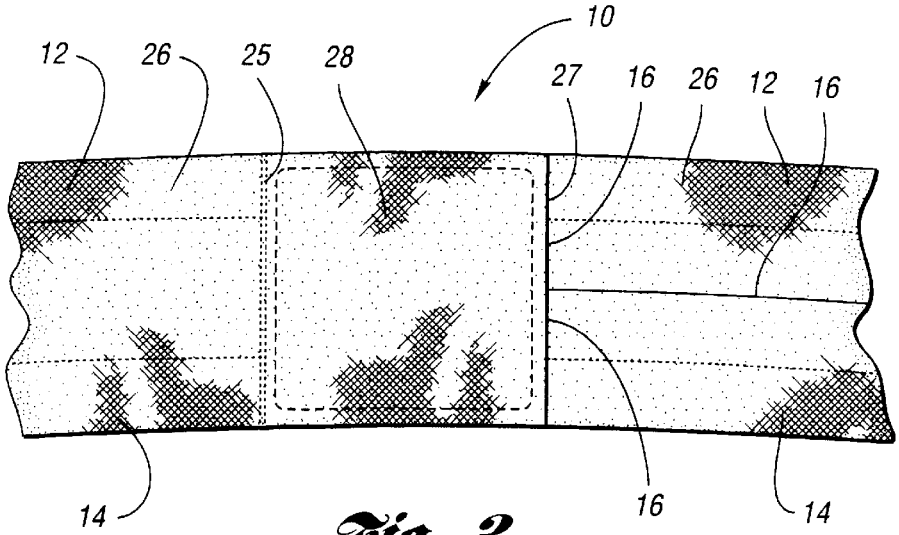
FIG. 3 is a partial plan view of the pocket.
Figure 4:
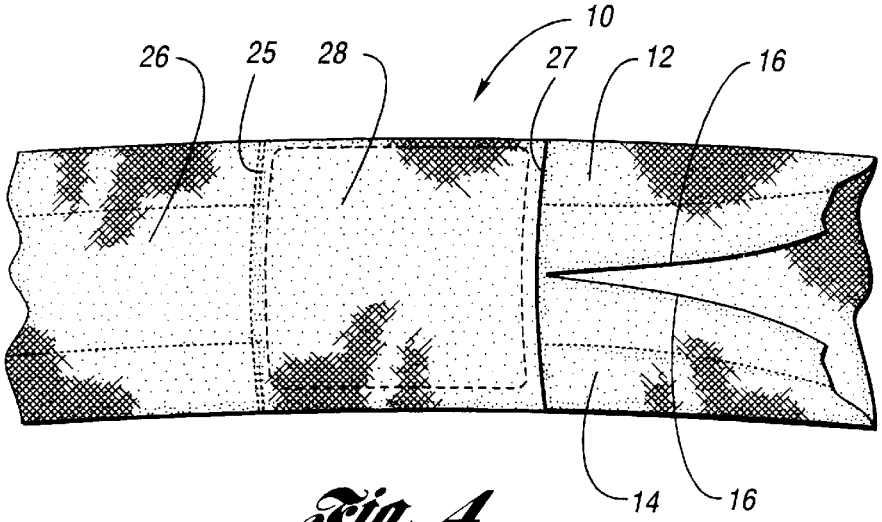
FIG. 4 is a partial plan view of the pocket and open pleats of the combination sling carrier and cushion.

As best shown in FIGS. 3 and 4, the support panel 28 and the attached portions of the carrier band 26 are illustrated. The carrier band 26 has opposed longitudinal sides 11, 13 in addition to pleats 16 which are sewn inwardly, facing the wearer 24 (not shown), at one end of the carrier band 26 providing a smooth back view of the wearer 24. On the other end of the carrier band 26, the pleats 16 are sewn outwardly which provides the fabric shelf 18 (not shown). The support panel 28 has a wide construction making the sling 10 comfortable for the wearer 24.

Figure 5:
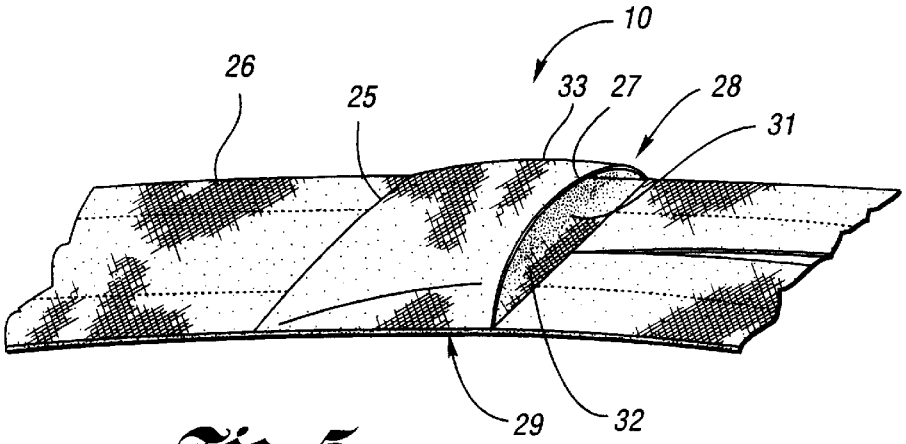
FIG. 5 illustrates the support panel and the pocket for storing the carrier band.

FIG. 5 illustrates the construction of the support panel 28. The support panel 28 comprises a first surface 29 for positioning the adjustment for the object being carried, a second surface 31, and a fabric panel 33 which is affixed to the second surface 31. The support panel 28 has a first closed end 25 and a second open end 27. The fabric panel 33 and the second surface 31 define a pocket 32 for the carrier band 26. The pocket 32 stores the carrier band 26 when the carrier 10 is in storage thereby creating a cushion 30 (not shown). The support panel 28 and carrier band 26 from a single piece unit eliminating any chance of the carrier 10 to come apart.

Figure 6:
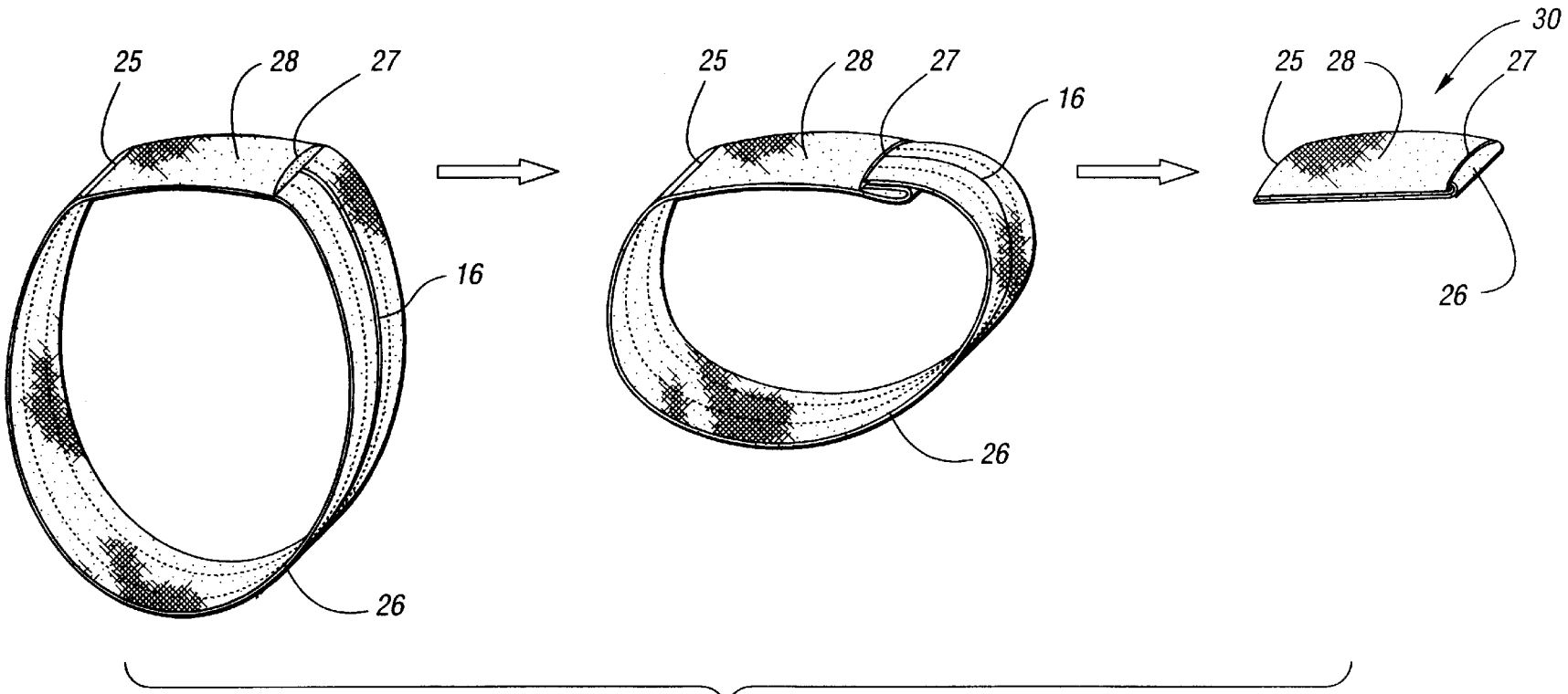
FIG. 6 is a plan view of the entire combination sling carrier and cushion in storage position.

FIG. 6 illustrates the combination sling carrier and cushion 10 converting to storage mode. As the carrier band 26 is folded into the pocket 32 of the support panel 28, the device becomes a cushion 30. The method of converting the sling carrier 10 into a cushion 30 requires one to hold the carrier 10 so that pleats 16 are facing up and the natural shelf 18 of the carrier band 26 is placed below the pleats 16. Next, the pleats 16 must be folded in a closed position. Then, the carrier band 26 must be folded up and into the pocket 32 of the support panel 28. Lastly, the carrier band 26 must be evenly distributed within the support panel 28 in order to create a comfortable cushion 30.

What is claimed is:

1. A combination sling carrier and cushion for safely transporting an animate object comprising:

a support panel forming a pocket having a first closed end and a second open end, the support panel lying upon the shoulder of the wearer when employed as a sling carrier, the support panel having a plurality of fabric layers serving to cushion the shoulder of the wearer, the support panel being operative to distribute the weight of the object around the shoulders of the wearer and to provide secure support to the object being carried; and a carrier band having opposed longitudinal sides, the carrier band being attached to the first closed end of the support panel and terminating at the second open end of the support panel, the carrier band being operative to support the object, whereby the carrier band is foldable into the second open end of the support panel, thereby creating a cushion when the carrier is not in use.

2. The carrier and cushion as recited in claim 1, the support panel further comprising:

a first surface for positioning adjustment to the object being carried;

a second surface; and a fabric panel affixed to the second surface wherein the fabric panel and the second surface define a pocket for receiving gathered carrier band to create a pillow and for storing the support band when the combination sling carrier is in storage.

3. The carrier and cushion as recited in claim 1, the support band further comprising:

at least two padded rails formed in the carrier band and extending along the opposed longitudinal sides of the carrier band, the padded rails being attached to the first closed end of the support panel and terminating at the second open end of the support panel, the padded rails being operative to secure the object in the carrier band.

4. The carrier and cushion as recited in claim 1, the carrier band being pleated at each end to create a natural shelf in the support band for supporting the object.

5. The carrier and cushion carrier and cushion as recited in claim 1 wherein the fabric panel and the carrier band are constructed from a flexible fabric material.

6. The carrier and cushion as recited in claim 1 wherein the carrier band and support panel are comprised of a one piece cloth.

7. A method of converting the combination sling carrier and cushion of claim 1, the sling carrier comprising a carrier band having pleats, the method comprising the steps of:

positioning the carrier with pleats facing up;

folding the carrier band into the pocket; and arranging the fabric within the pocket to evenly distribute the fabric within the pocket, thereby creating a cushion.

* * * * *